US007176940B2

(12) United States Patent
Choe et al.

(10) Patent No.: US 7,176,940 B2
(45) Date of Patent: Feb. 13, 2007

(54) METHOD AND APPARATUS FOR RENDERING COLOR IMAGE ON DELTA-STRUCTURED DISPLAYS

(75) Inventors: Won-hee Choe, Gyeongsangbuk-do (KR); Chang-yeong Kim, Kyungki-do (KR); Seong-deok Lee, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/622,433

(22) Filed: Jul. 21, 2003

(65) Prior Publication Data

US 2004/0113922 A1 Jun. 17, 2004

(30) Foreign Application Priority Data

Aug. 24, 2002 (KR) ..... 10-2002-0050308

(51) Int. Cl.
*G09G 5/00* (2006.01)

(52) U.S. Cl. ..... 345/613; 345/611

(58) Field of Classification Search ..... 345/589, 345/590, 611, 613, 660, 667, 668, 669
See application file for complete search history.

(56) References Cited

U.S. PATENT DOCUMENTS 5,280,347 A * 1/1994 Shiraishi et al. ..... 348/223.1
5,341,153 A 8/1994 Benzschawel et al.
6,188,385 B1 2/2001 Hill et al.
6,384,839 B1 5/2002 Paul
6,882,364 B1 * 4/2005 Inuiya et al. ..... 348/252

(Continued)

FOREIGN PATENT DOCUMENTS

EP 0 346 621 A2 12/1989

(Continued)

OTHER PUBLICATIONS

European Search Report issued by the European Patent Office on Mar. 18, 2005 in corresponding application.

(Continued)

*Primary Examiner*—Matthew Luu
(74) *Attorney, Agent, or Firm*—Buchanan Ingersoll & Rooney PC

(57) ABSTRACT

A method and apparatus for rendering a color image on a delta-structured display are provided. The method for rendering a color image on a display apparatus in which a pixel expressing an input image is formed with delta-structured sub-pixels, the method comprising: (a) forming a scaling filter which is used to make the resolution of the input image correspond to the resolution of the display apparatus; (b) obtaining a representative value of a sub-pixel of the display apparatus corresponding to a consideration area which is an area processed by the scaling filter in the input image; (c) obtaining the value of the sub-pixel based on the difference of pixels in the consideration area in the input image; (d) performing gamma correction of the sub-pixel value so that the sub-pixel is appropriate to the display apparatus; and (e) rendering the gamma-adjusted sub-pixel value on the display apparatus. By using the sub-pixel rendering method of a display apparatus, resolution is improved and the color fringe that can occur due to sub-pixel rendering is reduced.

19 Claims, 6 Drawing Sheets

U.S. PATENT DOCUMENTS

| | | | | |
|---|---|---|---|---|
| 2002/0145610 | A1* | 10/2002 | Barilovits et al. | 345/538 |
| 2003/0103058 | A1* | 6/2003 | Elliot et al. | 345/589 |
| 2003/0169354 | A1* | 9/2003 | Aotsuka | 348/272 |
| 2004/0061710 | A1* | 4/2004 | Messing et al. | 345/698 |

FOREIGN PATENT DOCUMENTS

| | | | |
|---|---|---|---|
| EP | 0 346 621 | A3 | 7/1992 |
| WO | 02/01546 | A1 | 1/2002 |

OTHER PUBLICATIONS

Michiel Klompenhouwer et al.; "Subpixel Image Scaling for Color Matrix Displays;" SID International Symposium Digest of Technical Papers; Boston, MA; May 21-23, 2002.

* cited by examiner

METHOD AND APPARATUS FOR RENDERING COLOR IMAGE ON DELTA-STRUCTURED DISPLAYS

This application claims priority from Korean Patent Application No. 2002-50308, filed Aug. 24, 2002, the contents of which are incorporated herein by reference in their entirety.

BACKGROUND OF THE INVENTION

1. Field of the Invention

The present invention relates to a method and apparatus for rendering a color image on a delta-structured display, and more particularly, to a method and apparatus for rendering an optimal color image on a delta-structured display apparatus, by using a sub-pixel rendering method with input images having different resolutions.

2. Description of the Related Art

In an image display apparatus, 3 sub-pixels, R, G, and B, are needed in order to express one pixel as the parts indicated by dotted lines in FIGS. 1 and 2. Accordingly, in a display apparatus, by manipulating the sub-pixels individually, a horizontal resolution can increase three times theoretically in the stripe topology of FIG. 2, and in the delta structure of FIG. 1, a horizontal resolution can increase 1.5 times and a vertical resolution can increase two times, theoretically. Meanwhile, when an image of a high resolution is desired to be displayed on a display apparatus having a low resolution, a jagged pattern occurs on the boundary of fine characters such as an Italic letter, in an ordinary individual pixel rendering method. This can be reduced by sub-pixel rendering, that is, individual manipulation of sub-pixels. However, the sub-pixel rendering has a drawback that it generates a color fringe on the boundary of an image. The color fringe is generated by a sudden change in the brightness value recognized between neighboring sub-pixels. This color fringe can be frequently found in the rendering of a diagonal line in the stripe structure and, this can be found in the rendering of a straight line in the vertical direction in the delta structure.

Among the existing patents written from the sub-pixel rendering perspective of an image display apparatus having this characteristic, there is a method of and apparatus for displaying a multicolor image by International Business Machines Corporation, U.S. Pat. No. 5,341,153, June 1988, in which a pixel of an input image is divided into R, G, B sub-pixels and rendered individually such that the effect of resolution improvement can be expected. In this technology, in order to render each sub-pixel, the average values of neighboring pixels about different central pixels of the input image corresponding to respective locations are used. However, though this technology improves the resolution, blurring is serious because a sub-pixel is rendered by the average value of the neighboring pixels, and a color fringe may occur in a sudden brightness change. Accordingly, rendering sub-pixels considering the characteristic of human eyesight is needed instead of the simple average of neighboring pixels.

When characters and graphics such as lines are desired to be rendered in a digital display apparatus such as an LCD, aliasing occurs in the sub-pixel rendering method. In a method and apparatus for rendering sub-pixel anti-aliased graphics, by Agfa Corporation, U.S. Pat. No. 6,384,839, September 1999, a method for reducing aliasing in a sub-pixel rendering method when such aliasing occurs is explained. In this technology, in order to determine the values of sub-pixels R, G, B, an LPF-filtered average value considering neighboring pixels of a corresponding location and the difference between the foreground and background are considered. This method is effective for a graphic image or characters in which the distinction between the foreground and the background is clear, but not appropriate to an image such as a natural image in which the distinction between the foreground and the background is not clear. Also, this method can be applied only to stripe topology color displays.

As described above, in the prior art technology of sub-pixel rendering for displaying a high resolution image on a low resolution display apparatus, blurring or color fringe occurs on the boundary, and the technology can be applied only to limited situations.

SUMMARY OF THE INVENTION

The present invention provides a method and apparatus for rendering a color image on a display apparatus, in which a pixel expressing an input image of an input image signal is formed with delta-structured sub-pixels, and for an ordinary image where the foreground and background are not divided, by using sub-pixel rendering on the delta-structured display apparatus, the resolution is improved and the color fringe occurring by the sub-pixel rendering is reduced such that a sub-pixel rendering method appropriate to the delta structure can be implemented.

According to an aspect of the present invention, there is provided a method for rendering a color image on a display apparatus in which a pixel expressing an input image that is the image of an input image signal is formed with delta-structured sub-pixels, the method comprising: (a) forming a scaling filter which is used to make the resolution of the input image correspond to the resolution of the display apparatus; (b) obtaining a representative value of a sub-pixel of the display apparatus corresponding to a consideration area which is an area processed by the scaling filter in the input image; and (c) rendering the filtered sub-pixel value on the display apparatus.

For better result, the method comprising: (a) forming a scaling filter which is used to make the resolution of the input image correspond to the resolution of the display apparatus; (b) obtaining a representative value of a sub-pixel of the display apparatus corresponding to a consideration area which is an area processed by the scaling filter in the input image; (c) obtaining the value of the sub-pixel based on the difference of pixels in the consideration area in the input image; (d) performing gamma correction of the sub-pixel value so that the sub-pixel is appropriate to the display apparatus; and (e) rendering the gamma-adjusted sub-pixel value on the display apparatus.

In the method, the step (a) comprises: (a1) calculating the ratio of resolutions between the input image and the display apparatus; (a2) determining the number of masks of a scaling filter, based on the cycle of alternation in the horizontal direction and in the vertical direction between the pixel of the input image calculated by using the resolution ratio obtained in the step (a1) and the sub-pixel of the display apparatus having a delta structure; and (a3) taking centroids of sub-pixels corresponding to respective masks as the centers of the masks, and determining the coefficients of the masks in proportion to the size of the masks.

In the method, in the masks of the step (a3) the shape depends on sub-pixel structuring.

In the method, in the step (b) the representative value of the sub-pixel is obtained by giving a weighted value based on the distance to the central location of the sub-pixel of the display apparatus, to the values of the pixels of the input image in the consideration area.

In the method, in the step (c) the value of the output sub-pixel is rendered by considering the product of coefficients of a scaling filter which corresponds to input pixels corresponding to the location of the sub-pixel and the difference between the representative value of the output sub-pixel obtained in the step (b) and neighboring input pixels in a corresponding area.

In the method, in the step (d) the value of the output sub-pixel is corrected based on the gamma value of individual components of the sub-pixel.

According to another aspect of the present invention, there is provided an apparatus for rendering a color image on a display apparatus in which a pixel expressing an input image is formed with delta-structured sub-pixels, the apparatus comprising: a scaling filter forming unit which forms a scaling filter which is used to make the resolution of the input image correspond to the resolution of the display apparatus; a sub-pixel representative value extracting unit which obtains a representative value of a sub-pixel of the display apparatus corresponding to a consideration area which is an area processed by the scaling filter in the input image; a sub-pixel value adjusting unit which obtains the value of the sub-pixel based on the difference of pixels in the consideration area in the input image; a gamma correction unit which performs correction of the sub-pixel value so that the sub-pixel is appropriate to the display apparatus; and a rendering unit which renders the gamma-adjusted sub-pixel value on the display apparatus.

BRIEF DESCRIPTION OF THE DRAWINGS

The above objects and advantages of the present invention will become more apparent by describing in detail preferred embodiments thereof with reference to the attached drawings in which.

DESCRIPTION OF THE PREFERRED EMBODIMENTS

Figure 1:
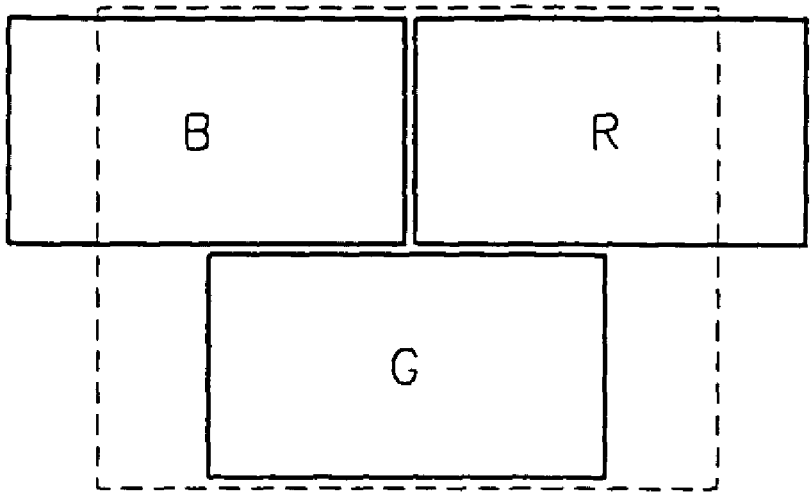
FIG. 1 is a diagram of the structure of RGB sub-pixels expressed as one pixel appearing on a delta-structured display.
Figure 2:
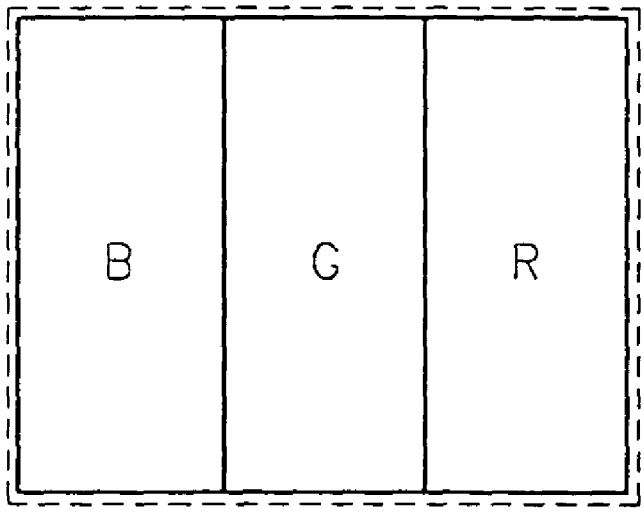
FIG. 2 is a diagram of the structure of RGB sub-pixels expressed as one pixel appearing on a stripe topology display.
Figure 3:
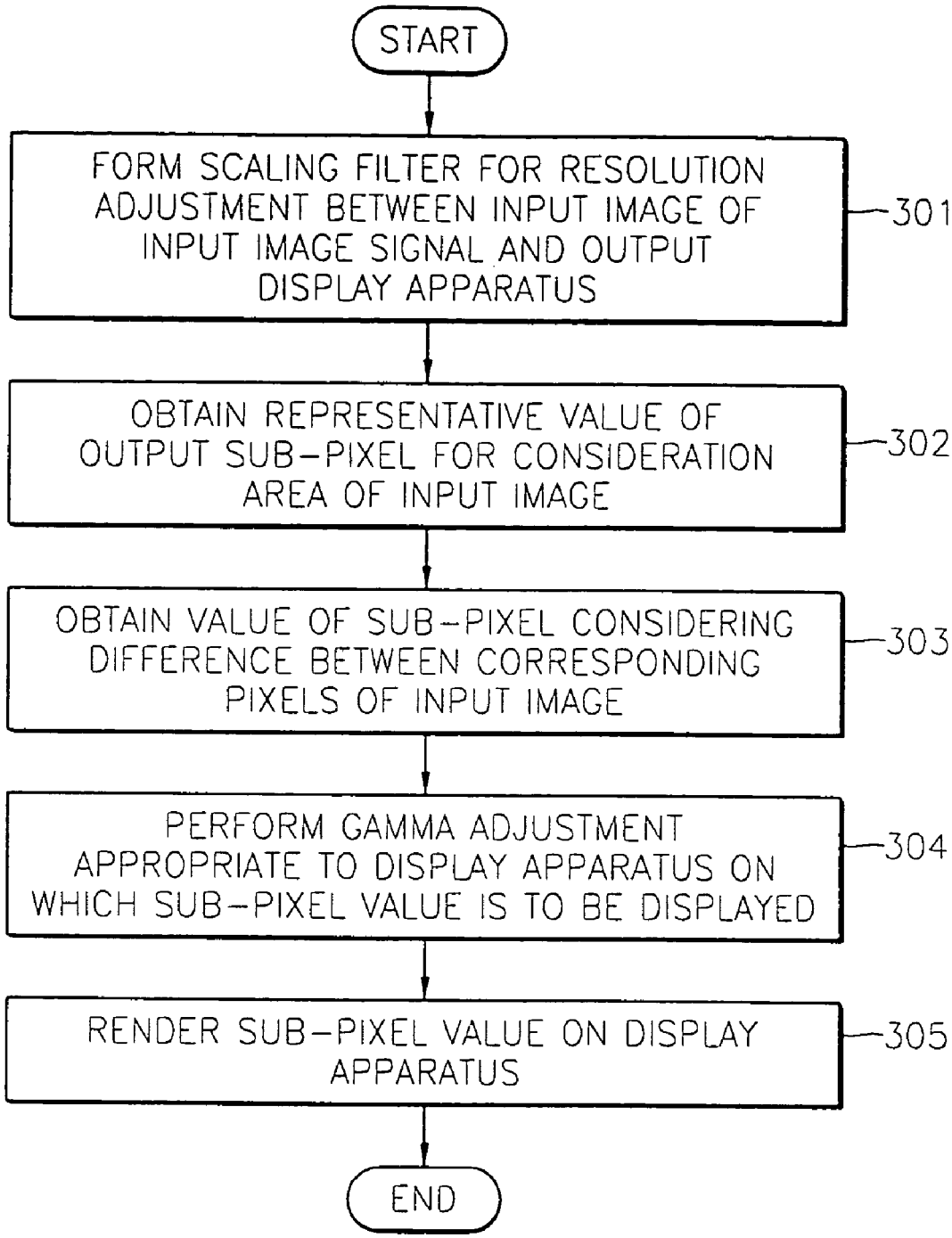
FIG. 3 is a flowchart of the steps performed by a method for rendering a color image on a delta-structured display.

FIG. 3 is a flowchart of the steps performed by a method for rendering a color image on a delta-structured display and shows a method for rendering a high resolution color image in a low resolution delta-structure display apparatus through sub-pixel rendering according to the present invention.

In the method for rendering a color image on a delta-structured display apparatus according to the present invention, first, a scaling filter appropriate to an output display apparatus is formed for an input image in step 301.

Secondly, a representative value of an output sub-pixel for a consideration area of the input image is obtained in step 302.

Thirdly, the value of a sub-pixel considering the difference between corresponding pixels of the input image is obtained in step 303.

Fourthly, gamma correction appropriate to a display apparatus on which the value of a sub-pixel is rendered is performed in step 304, and fifthly, the value of the sub-pixel is rendered on the display apparatus in step 305.

The steps can be implemented by software in a computer system or as hardware in a display apparatus.

Each of the steps will now be explained in more detail.

Figure 4:
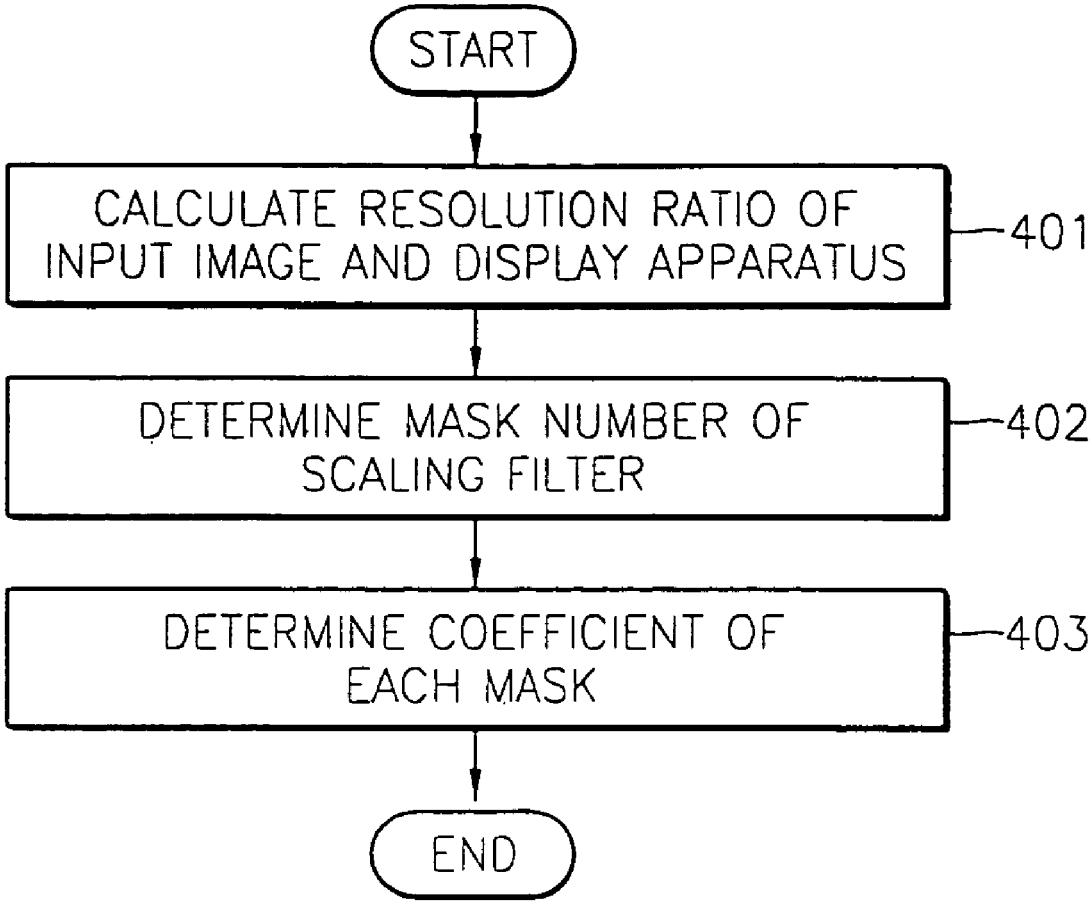
FIG. 4 is a flowchart of the steps performed by a method for determining a mask coefficient of a scaling filter.

First, in the step 301, resolution adjustment between the input image and a display apparatus is carried out through the process shown in FIG. 4. That is, the number of scaling filters and coefficients for determining the output value of a sub-pixel in sub-pixel rendering are determined.

FIG. 4 is a flowchart of the steps performed by a method for determining a mask coefficient of a scaling filter.

In step 401, the resolution ratio between the input image and the display apparatus is calculated.

Then, in step 402, the number of masks of the scaling filter is determined.

In step 403, the coefficient of each mask is determined.

In the step 402, the cycle of alternation between apparatuses is determined by the resolution ratio obtained in the step 401, and the number of masks that can appear in one cycle in the vertical direction and in the horizontal direction is obtained by the cycle of alternation between a pixel of the input image and a sub-pixel on the delta-structured display in the horizontal direction and in the vertical direction.

Figure 5:
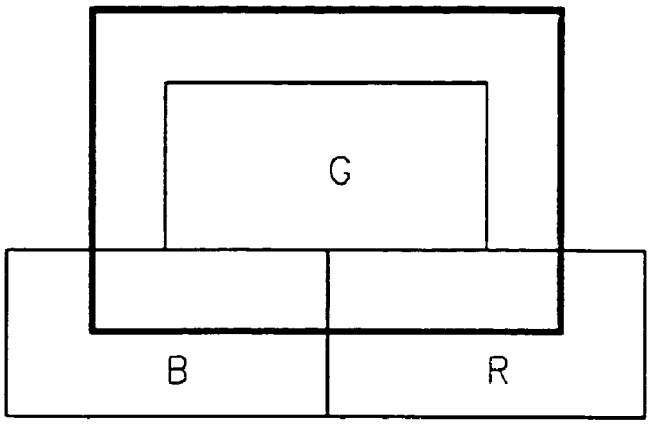
FIG. 5 is the shape of an ordinary mask of a scaling filter determining the value of a sub-pixel in a delta structure.
Figure 6:
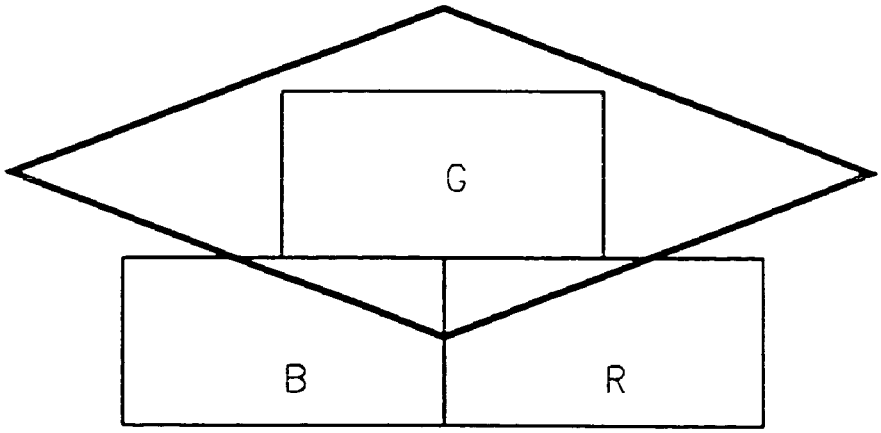
FIG. 6 is the shape of a mask of a scaling filter determining the value of a sub-pixel appropriate to a delta structure.

In the step 403, mask coefficients are defined for each of masks determined in the step 402. At this time, the shape of a mask defined by the scaling filter may be the same shape as one pixel of the existing display apparatus as shown in FIG. 5, or may be expressed as a rhombus shape which considers the characteristic of a modulation transfer function (MTF) of human eyesight which is sensitive to a vertical and horizontal contrast, and can consider the vertical and horizontal areas more than the area in the diagonal direction. In particular, since the delta-structured sub-pixels cause more color fringes in a straight line boundary in the vertical direction, the value of an input pixel in the horizontal direction should have a bigger weighted value in determining sub-pixel values than that in the vertical direction. Accordingly, the mask shape of the scaling filter which determines the value of a sub-pixel appropriate to the delta structure is a rhombus shape in which the horizontal axis is longer than the vertical axis as expressed by solid lines in FIG. 6. At this time, the coefficient of the generated rhombus-shaped mask may be determined in proportion to an area overlapping the pixel of the input image. Here, in order to render a color on an accurate location, the centroid of a mask for rendering a sub-pixel should always correspond to the center of the sub-pixel.

In the step 302, a consideration area for an area in which a corresponding output sub-pixel overlaps the input image is determined. Through a mask operation with input pixels included in a consideration area, a representative value indicating an output sub-pixel is obtained by the following equation 1:

$$Mi = \sum_k C_{nk} Vi_k \tag{1}$$

The equation 1 expresses k input pixels ($Vi_k$) corresponding to an arbitrary output sub-pixel in the form of products with coefficients ($C_{nk}$) of the n-th scaling filter. The equation 1 is designed to give a weighted value considering the distance from the central location of an output sub-pixel, to the values of corresponding input pixels in order to obtain a representative value of each output sub-pixel.

In the step 303, in order to reduce blurring due to lowering of resolution, an improved output sub-pixel value is obtained by considering the differences between input pixels included in the consideration area and representative value expressing an output sub-pixel value, and this can be expressed as the following equation 2:

$$Vo' = \sum_k C_{nk}\left(Vi_k + aD_k \times \frac{Vi_k}{Vi_{\mathrm{MAX}}}\right) \tag{2}$$

$$D_k = Mi - Vi_k \tag{3}$$

The equation 2 expresses an arbitrary sub-pixel value (Vo') by using the product of k input pixels ($Vi_k$) by corresponding scaling filter coefficients, and the product of input pixels ($Vi_k$) by a value considering the difference ($D_k$) between the representative value (Mi) of an output sub-pixel obtained in the step 2 expressed by the equation 3 and neighboring pixels ($Vi_k$) in the corresponding area. Here, since the weighted value considering a corresponding input pixel increases in proportion to the difference with neighboring pixels, blurring caused by lowering of resolution can be reduced even in an image including a boundary in which the difference of values is great.

In the step 304, gamma correction appropriate to a display apparatus, on which the value of a sub-pixel is displayed, is performed. In general, an image display apparatus has a gamma characteristic of a value between 2.0 and 2.4. Accordingly, in order to render color information of an arbitrary input image in a color appropriate to a display apparatus, the gamma characteristic of the display apparatus, on which the image is desired to be displayed, should be corrected for individual components of each sub-pixel. Through this process, the distribution of values of sub-pixels rendered on the display can be a linear distribution. At this time, gamma correction of the display apparatus for the value (Vo') of an input sub-pixel is expressed as the following equation 4:

$$Vo = Vo_{\max} \times \left(\frac{Vo'}{Vo_{\max}}\right)^{\gamma} \tag{4}$$

The equation 4 shows performing gamma correction $$\left(\frac{1}{\gamma}\right)$$

in order to make the value (Vo') of a sub-pixel, which is obtained in the step 303 and is to be rendered on a display, an accurate color value on the display apparatus, that is, an output sub-pixel value (Vo). At this time, gamma (γ) expressed in the equation 4 indicates a value which is measured for individual components of each sub-pixel.

In the step 305, the output sub-pixel value (Vo) which is obtained in the step 304 and is to be displayed on the display apparatus is displayed. For this, by rendering each sub-pixel value on a variety of display apparatuses having a delta sub-pixel structure, an image with improved resolution can be displayed.

Figure 7:
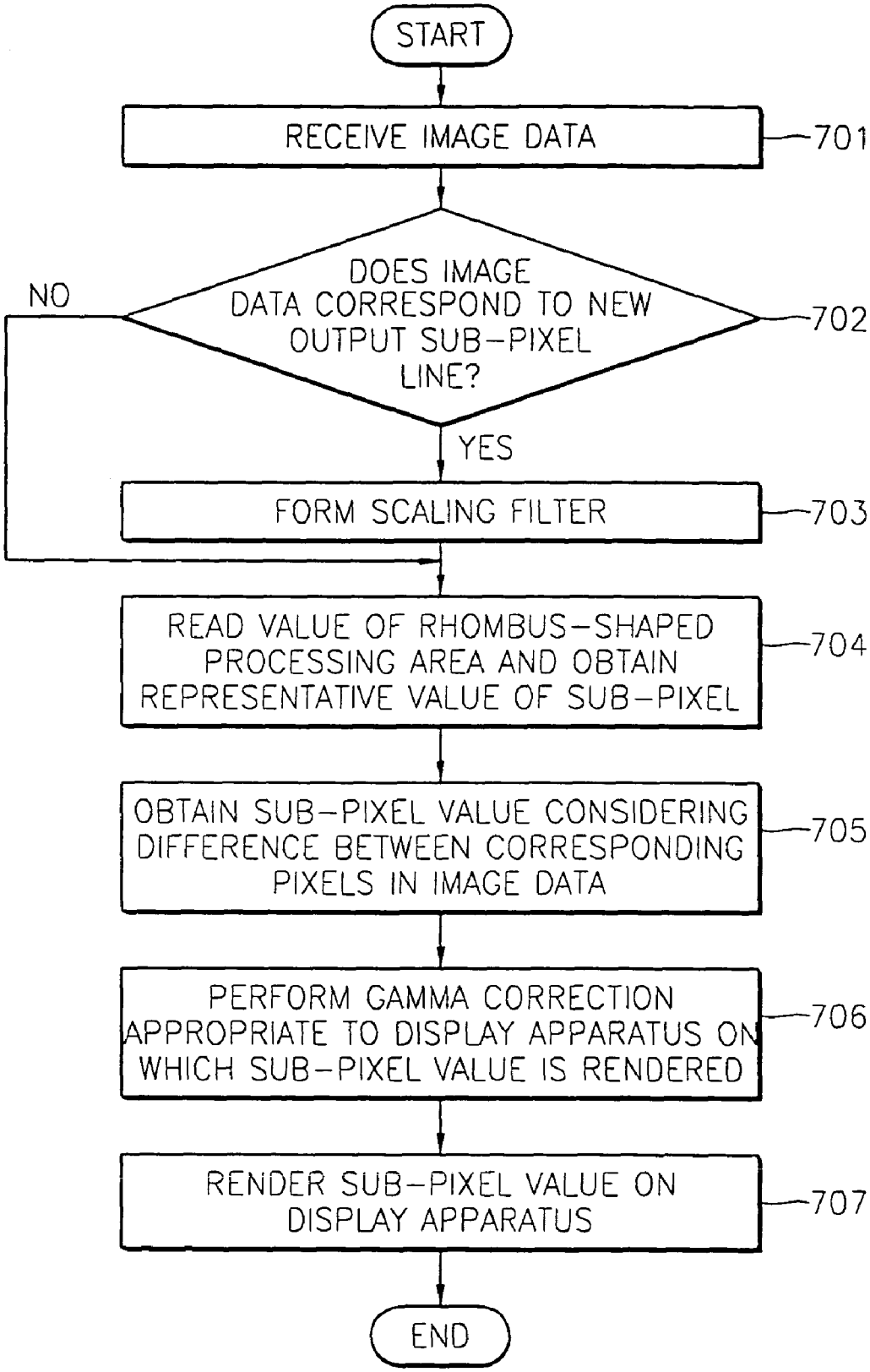
FIG. 7 is a flowchart of the steps performed by a preferred embodiment of a method for rendering a color image on a display apparatus.

FIG. 7 is a flowchart of the steps performed by a preferred embodiment of a method for rendering a color image on a display apparatus. In FIG. 7, the mask of a scaling filter using the ratio of the input image and the ratio of the display apparatus can be obtained by the steps of FIG. 4, and the defined mask is sequentially applied in order of the sub-pixel line of the display apparatus. Also, rendering of sub-pixels of the display apparatus using an input image can be obtained by equations 1 through 4.

The process will now be explained in order. First, image data are input in step 701. Then, it is determined whether or not a sub-pixel line to be calculated is a new sub-pixel line in step 702. If the line is a new sub-pixel line, a scaling filter is formed in step 703. Then, input pixel values in a rhombus-shaped processing area (consideration area) are read and the representative value of a sub-pixel is obtained in step 704. Next, a sub-pixel value considering the difference between corresponding pixels of the image data is obtained in step 705. Then, gamma correction appropriate to a display apparatus on which the sub-pixel value is rendered is carried out in step 706. The sub-pixel value is displayed on the display apparatus in step 707. If the determination result of the step 702 indicates that the line of a next output sub-pixel is not a new sub-pixel line, the step 704 is performed.

Figure 8:
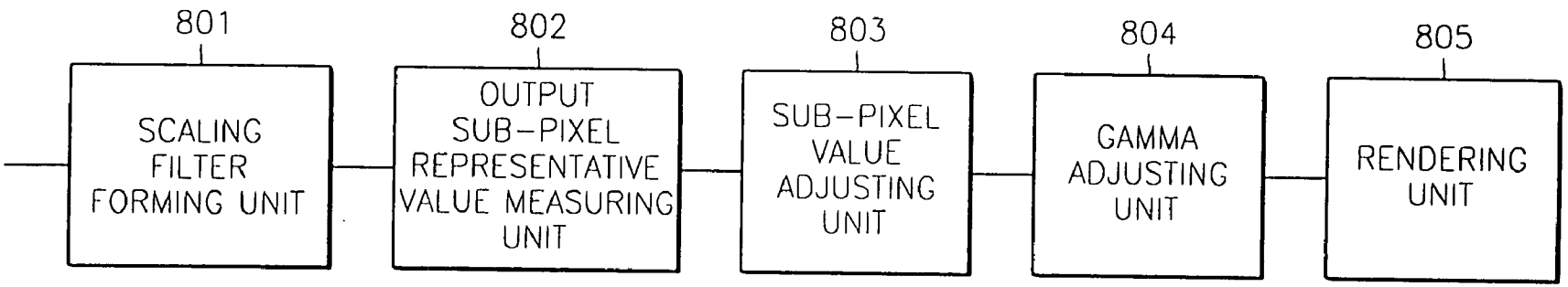
FIG. 8 is a block diagram of the structure of a preferred embodiment of an apparatus for rendering a color image on a delta-structured display apparatus according to the present invention.

FIG. 8 is a block diagram of the structure of a preferred embodiment of an apparatus for rendering a color image on a delta-structured display apparatus according to the present invention. The apparatus comprises a scaling filter forming unit 801, an output sub-pixel representative value measuring unit 802, a sub-pixel value adjusting unit 803, a gamma adjusting unit 804, and a rendering unit 805.

The scaling filter forming unit 801 forms a scaling filter which is used to make the resolution of an input image that is the image of an input signal correspond to the resolution of a display apparatus.

The sub-pixel representative value measuring unit 802 obtains the representative value of a sub-pixel of the display apparatus corresponding to a consideration area which is an area processed by the scaling filter in the input image.

The sub-pixel value adjusting unit 803 obtains the value of the sub-pixel based on the difference between pixels of the consideration area in the input image.

The gamma correction unit 804 performs gamma correction of the value of the sub-pixel so that the value of the sub-pixel is appropriate to the display apparatus.

The rendering unit 805 renders the value of the gamma-adjusted sub-pixel value on the display apparatus.

The present invention may be embodied in a code, which can be read by a computer, on a computer readable recording medium. The computer readable recording medium includes all kinds of recording apparatuses on which computer readable data are stored.

The computer readable recording media includes storage media such as magnetic storage media (e.g., ROM's, floppy disks, hard disks, etc.), optically readable media (e.g., CD-ROMs, DVDs, etc.) and carrier waves (e.g., transmissions over the Internet).

Optimum embodiments have been explained above and are shown. However, the present invention is not limited to the preferred embodiment described above, and it is apparent that variations and modifications by those skilled in the art can be effected within the spirit and scope of the present invention defined in the appended claims. Therefore, the scope of the present invention is not determined by the above description but by the accompanying claims.

According to the present invention, by using the sub-pixel rendering method of a display apparatus, resolution is improved and the color fringe that can occur due to sub-pixel rendering is reduced. Also, the method and apparatus for rendering a color image on a delta-structured display has a scaler function, by which an input image of a high resolution can be displayed on a display apparatus having a low resolution, and renders sub-pixels of the display apparatus such that the resulting resolution is better than the actual resolution of the display apparatus and the color fringe appearing in a delta sub-pixel structure is efficiently reduced. In addition, by doing gamma adjustment for rendering accurate colors of the display, a more accurate image can be reproduced.

What is claimed is:

1. A method for rendering a color image on a display apparatus in which a pixel expressing an input image is formed with delta-structured sub-pixels, the method comprising:

(a) forming a scaling filter which is used to make the resolution of the input image correspond to the resolution of the display apparatus;

(b) obtaining a representative value of a sub-pixel of the display apparatus corresponding to a rhombus-shaped consideration area which is an area processed by the scaling filter in the input image such that the representative value of the sub-pixel of the display is weighted considering the values of areas of subpixels within the consideration area of input pixels; and (c) rendering the filtered sub-pixel value on the display apparatus.

2. The method of claim 1, wherein the step (a) comprises:

(a1) calculating the ratio of resolutions between the input image and the display apparatus;

(a2) determining the number of masks of a scaling filter, based on the cycle of alternation in the horizontal direction and in the vertical direction between the pixel of the input image calculated by using the resolution ratio obtained in the step (a1) and the sub-pixel of the display apparatus having a delta structure; and (a3) taking centroids of sub-pixels corresponding to respective masks as the centers of the masks, and determining the coefficients of the masks in the proportion to the size of the masks.

3. The method of claim 2, wherein in the masks of the step (a3) the shape depends on sub-pixel structuring.

4. The method of claim 1, wherein in the step (b) the representative value of the sub-pixel is obtained by giving a weighted value to the respective pixel of the input image in the consideration area based on a distance of the pixel to a central location of the sub-pixel of the display apparatus.

5. A method for rendering a color image on a display apparatus in which a pixel expressing an input image is formed with delta-structured sub-pixels, the more complex method comprising:

(a) forming a scaling filter which is used to make the resolution of the input image correspond to the resolution of the display apparatus;

(b) obtaining a representative value of a sub-pixel of the display apparatus corresponding to a rhombus-shaped consideration area which is an area processed by the scaling filter in the input image such that the representative value of a sub-pixel of the display is weighted considering the values of areas of subpixels within the consideration area of input pixels;

(c) obtaining the value of the sub-pixel based on the difference of pixels in the consideration area in the input image;

(d) performing gamma correction of the sub-pixel value so that the sub-pixel is appropriate to the display apparatus; and (e) rendering the gamma-adjusted sub-pixel value on the display apparatus.

6. The method of claim 5, wherein in the step (c) the value of the output sub-pixel is rendered by considering the product of coefficients of a scaling filter which corresponds to input pixels corresponding to the location of the sub-pixel and the difference between the representative value of the output sub-pixel obtained in the step (b) and neighboring input pixels in a corresponding area.

7. The method of claim 5, wherein in the step (d) the value of the output sub-pixel is corrected based on the gamma value of individual components.

8. An apparatus for rendering a color image on a display apparatus in which a pixel expressing an input image is formed with delta-structured sub-pixels, the apparatus comprising:

a scaling filter forming unit which forms a scaling filter which is used to make the resolution of the input image correspond to the resolution of the display apparatus;

a sub-pixel representative value extracting unit which obtains a representative value of a sub-pixel of the display apparatus corresponding to a rhombus-shaped consideration area which is an area processed by the scaling filter in the input image such that the representative value of a sub-pixel of the display is weighted considering the values of areas of subpixels within the consideration area of input pixels;

a sub-pixel value adjusting unit which obtains the value of the sub-pixel based on the difference of pixels in the consideration area in the input image;

a gamma correction unit which performs correction of the sub-pixel value so that the sub-pixel is appropriate to the display apparatus; and a rendering unit which renders the gamma-adjusted sub-pixel value on the display apparatus.

9. A computer readable medium having embodied thereon a computer program for the method of claim 1.

10. A computer readable medium having embodied thereon a computer program for the method of claim 2.

11. A computer readable medium having embodied thereon a computer program for the method of claim 3.

12. A computer readable medium having embodied thereon a computer program for the method of claim 4.

13. A computer readable medium having embodied thereon a computer program for the method of claim 5.

14. A computer readable medium having embodied thereon a computer program for the method of claim 6.

15. The method of claim 1, wherein the rhombus-shaped consideration area as a horizontal axis and a vertical axis wherein the horizontal axis is longer than the vertical axis.

16. The method of claim 5, wherein the rhombus-shaped consideration area as a horizontal axis and a vertical axis wherein the horizontal axis is longer than the vertical axis.

17. The method of claim 8, wherein the rhombus-shaped consideration area as a horizontal axis and a vertical axis wherein the horizontal axis is longer than the vertical axis.

18. The method of claim 1, wherein the rhombus-shaped consideration area has a centroid, the centroid of the consideration area corresponding to the center of the sub-pixel.

19. The method of claim 5, wherein the rhombus-shaped consideration area has a centroid, the centroid of the consideration area corresponding to the center of the sub-pixel.

* * * * *